US008139004B2

(12) United States Patent
Yamashita et al.

(10) Patent No.: US 8,139,004 B2
(45) Date of Patent: Mar. 20, 2012

(54) DISPLAY DEVICE AND ELECTRONIC APPARATUS

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 1031 days.

(21) Appl. No.: 12/076,808

(22) Filed: Mar. 24, 2008

(65) Prior Publication Data

US 2009/0201233 A1 Aug. 13, 2009

(30) Foreign Application Priority Data

Mar. 26, 2007 (JP) ..... 2007-078217

(51) Int. Cl.
*G09G 3/32* (2006.01)

(52) U.S. Cl. ..... 345/80; 345/82; 345/76; 345/211; 345/208; 315/169.3

(58) Field of Classification Search ..... 345/80, 345/213, 55, 45–46, 76, 212, 211; 315/169.3
See application file for complete search history.

(56) References Cited

U.S. PATENT DOCUMENTS

| | | | | |
|---|---|---|---|---|
| 7,956,829 | B2 * | 6/2011 | Iida et al. | 345/80 |
| 2005/0269959 | A1 * | 12/2005 | Uchino et al. | 315/169.3 |
| 2006/0261864 | A1 * | 11/2006 | Miyazawa | 327/112 |

FOREIGN PATENT DOCUMENTS

| | | | | |
|---|---|---|---|---|
| JP | 2003-255856 | A | | 9/2003 |
| JP | 2003-271095 | A | | 9/2003 |
| JP | 2004-029791 | A | | 1/2004 |
| JP | 2004-093682 | A | | 3/2004 |
| JP | 2004-133240 | A | | 4/2004 |
| JP | 2007034000 | A | * | 2/2007 |

* cited by examiner

*Primary Examiner* — Lun-Yi Lao
*Assistant Examiner* — Olga Merkoulova
(74) *Attorney, Agent, or Firm* — Rader, Fishman & Grauer PLLC

(57) ABSTRACT

A display device includes a drive section and a pixel array section including power lines, scanning lines, signal lines, and pixels in a matrix. Each pixel includes a sampling transistor, a drive transistor, a light-emitting element, and a storage capacitor. The drive section includes a write scanner supplying a control signal to one scanning line at a time, and a signal selector supplying a drive signal to each signal line. The sampling transistor applies the drive signal to the drive transistor. The drive transistor supplies a drive current based on the drive signal to the light-emitting element. The write scanner includes output buffers, each outputting a control signal including two pulses to a corresponding scanning line. Each output buffer includes first and second output sections, the first section outputting one pulse and the second section extracting a pulse from a pulse power supply and outputting the extracted pulse.

8 Claims, 13 Drawing Sheets

DISPLAY DEVICE AND ELECTRONIC APPARATUS

CROSS REFERENCES TO RELATED APPLICATIONS

The present invention contains subject matter related to Japanese Patent Application JP 2007-078217 filed in the Japanese Patent Office on Mar. 26, 2007, the entire contents of which are incorporated herein by reference.

BACKGROUND OF THE INVENTION

1. Field of the Invention

The present invention relates to an active-matrix display device using light-emitting elements as pixels and to an electronic apparatus including a display device of this type.

2. Description of the Related Art

In recent years, planar light-emitting display devices using organic electroluminescent (EL) devices as light-emitting elements have been actively developed. Organic EL devices are devices using the phenomenon that an organic thin film emits light when an electric field is applied thereto. Organic EL devices, which operate at an application voltage of 10 V or less, consume low power. Because organic EL devices are elements that emit light (light-emitting elements), no illuminator is necessary. Thus, the weight and thickness of a display device using organic EL devices can be easily reduced. Furthermore, the response speed of organic EL devices is a few microseconds, which is very fast. Thus, afterimage is generated when a moving image is displayed.

Among planar light-emitting display devices using organic EL devices as pixels, active-matrix display devices having thin-film transistors (TFTs) as drive elements, which are integrated in pixels, are actively developed. Active-matrix planar light-emitting display devices are described in, for example, Japanese Unexamined Patent Application Publication Nos. 2003-255856, 2003-271095, 2004-133240, 2004-029791, and 2004-093682.

SUMMARY OF THE INVENTION

Active-matrix planar light-emitting display devices of the related art have variations in the threshold voltage and mobility of drive transistors for driving light-emitting elements based on process variations. In addition, the current/voltage characteristics of organic EL devices change over time. Such variations in the characteristics of transistors and changes in the characteristics of organic EL devices have an influence on the luminance of light emission. In order to make the luminance of light emission uniform throughout the entire screen of a display device, it is necessary to correct the foregoing variations and changes in the characteristics of drive transistors and organic EL devices in pixel circuits. Thus, proposal has been made in the related art to provide a display device having pixels with such a correction function.

Active-matrix planar light-emitting display devices of the related art generally have, besides drive transistors for driving light-emitting elements, additional sampling transistors for sampling a video signal potential and a reference potential and storing the sampled potentials in pixels. In order to cause pixels to perform various correction operations, it is necessary for a display device with a correction function of the related art to drive the sampling transistors on and off a plurality of times in each horizontal scanning period and to sample a signal potential and a reference potential in accordance with a predetermined sequence. This involves a high-speed gate pulse for driving the sampling transistors on and off, which results in a higher drive current of a display panel and an increase in power consumption.

In view of the foregoing problem of the related art, it is desirable to provide a display device that causes pixels to perform various correction operations and to suppress power consumption. To this end, according to an embodiment of the present invention, there is provided a display device including a pixel array section and a drive section. The pixel array section includes power lines, scanning lines arranged in rows, signal lines arranged in columns, and pixels that are arranged in a matrix and that are disposed at intersections of the scanning lines and the signal lines. Each of the pixels at least includes a sampling transistor, a drive transistor, a light-emitting element, and a storage capacitor. The sampling transistor has a control end connected to a corresponding one of the scanning lines and a pair of current ends connected between a corresponding one of the signal lines and a control end of the drive transistor. The drive transistor has a pair of current ends, one current end being connected to the light-emitting element and the other current end being connected to a corresponding one of the power lines. The storage capacitor is connected between the control end of the drive transistor and the one current end of the drive transistor. The drive section includes a write scanner configured to sequentially supply a control signal to one of the scanning lines at a time in each horizontal scanning period, and a signal selector configured to supply a drive signal to each of the signal lines, the drive signal being switched between a signal potential and a reference potential in each horizontal scanning period. The sampling transistor applies the drive signal to the control end of the drive transistor in accordance with the control signal. The drive transistor supplies a drive current to the light-emitting element in accordance with the drive signal. The write scanner includes output buffers, each of the output buffers being configured to output a control signal to a corresponding one of the scanning lines, the control signal including a first pulse and a second pulse in each horizontal scanning period. Each of the output buffers includes a first output section connected to a fixed power supply, outputting the first pulse, and a second output section connected to a pulse power supply, extracting the pulse supplied from the pulse power supply and outputting the extracted pulse as the second pulse.

Preferably, the sampling transistor samples the reference potential of the drive signal in accordance with the first pulse output from the first output section, thereby causing the pixel to perform a threshold-voltage correcting operation for correcting a variation in a threshold voltage of the drive transistor. Preferably, the sampling transistor samples the signal potential of the drive signal in accordance with the second pulse output from the second output section, thereby causing the pixel to write the signal potential in the storage capacitor and simultaneously perform a mobility correcting operation for correcting a variation in mobility of the drive transistor. Furthermore, each of the output buffers in the write scanner may sequentially output the first pulse and the second pulse in each horizontal scanning period so that the first pulse and the second pulse do not overlap each other with respect to time. In this case, each of the output buffers in the write scanner first outputs the first pulse, and after a period of time, outputs the second pulse in each horizontal scanning period. Preferably, the drive section includes a power scanner configured to switch each of the power lines between a high potential and a low potential. When each of the pixels performs the threshold-voltage correcting operation, the power scanner first switches a corresponding one of the power lines to the low potential and then to the high potential.

According to the embodiment of the present invention, the write scanner includes a plurality of output buffers, each of which is configured to output a control signal to a corresponding one of the scanning lines, the control signal including a first pulse and a second pulse in each horizontal scanning period. Accordingly, the sampling transistor is turned on and off two times in each horizontal scanning period, thereby allowing the pixel to perform the threshold-voltage correcting operation and the signal writing and mobility correcting operation. In this case, each of the output buffers are divided into the first output section connected to a fixed power supply, and the second output section connected to a pulse power supply. The first output section outputs the first pulse. The second output section extracts a pulse supplied from the pulse power supply and outputs the extracted pulse as the second pulse to a corresponding one of the scanning lines. Thus, is only necessary for the pulse power supply to output only one pulse, instead of two pulses, in each horizontal scanning period. This reduces the effective operating frequency and the power consumption of the display panel.

The accuracy of pulses included in a control signal is different according to the content of a correction operation. In a correction operation where relatively high accuracy is necessary, the second pulse, which is a pulse of high accuracy supplied from the second output section, is used. In a correction operation where high accuracy is not necessary, the first pulse output from the first output section is sufficient. In general, a control signal obtained by extracting a pulse supplied from a pulse power supply has less waveform distortion and less propagation delay and is highly accurate. In contrast, the waveform of a pulse supplied from the first output section, which is connected to the fixed power supply including a general inverter or the like, is blurred. Since the first pulse varies among the scanning lines, the first pulse has a low accuracy. According to the embodiment of the present invention, two types of pulses with different levels of accuracy are appropriately used, thereby reducing the load on the pulse power supply and reducing the power consumption of modules in the display device.

DESCRIPTION OF THE PREFERRED EMBODIMENTS

Embodiments of the present invention will be described now herein in detail with reference to the drawings.

Figure 1:
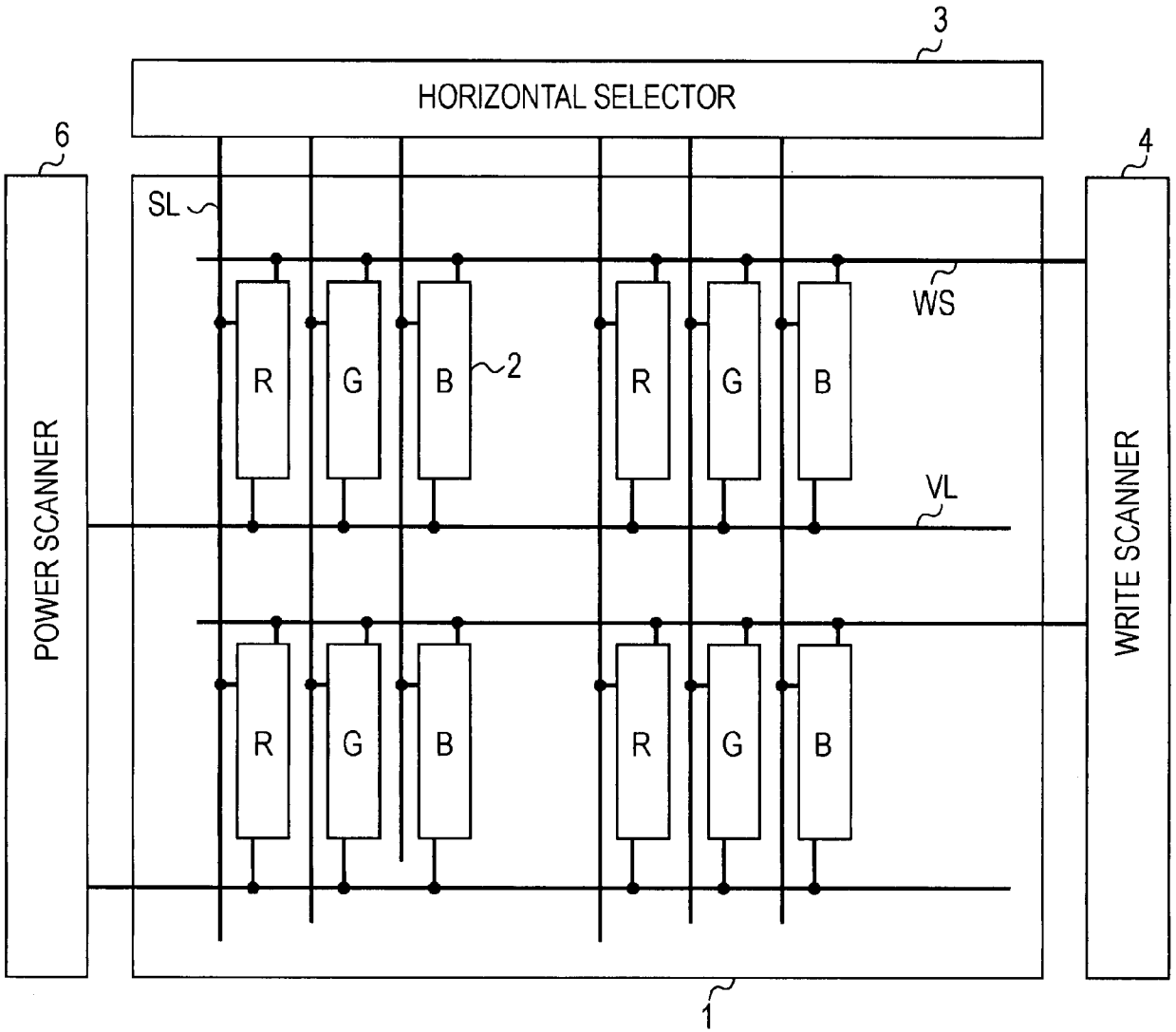
FIG. 1 is a block diagram of the overall structure of a display device according to an embodiment of the present invention.

FIG. 1 is a block diagram of the overall structure of a display device according to an embodiment of the present invention. As shown in FIG. 1, the display device includes a pixel array section 1 and a drive section configured to drive the pixel array section 1. The pixel array section 1 includes scanning lines WS arranged in rows, signal lines SL arranged in columns, pixels 2 that are arranged in a matrix and that are disposed at intersections of the scanning lines WS and the signal lines SL, and power lines VL provided in correspondence with rows of the pixels 2. In this example, one of the red, green, and blue (RGB) primary colors is allocated to each of the pixels 2, and a color display can be achieved. However, the embodiment is not limited to a color display and is applicable to a single-color display device. The drive section includes a write scanner 4 configured to sequentially supply a control signal to the scanning lines WS and to scan the pixels 2 on a row-by-row basis in a line-sequential manner, a power scanner 6 configured to feed a power supply voltage switched between a first potential and a second potential to the power lines VL in accordance with this line-sequential scanning, and a signal selector (horizontal selector) 3 configured to supply a signal potential serving as a drive signal and a reference potential to the signal lines SL, which are arranged in columns, in accordance with the line-sequential scanning.

Figure 2:
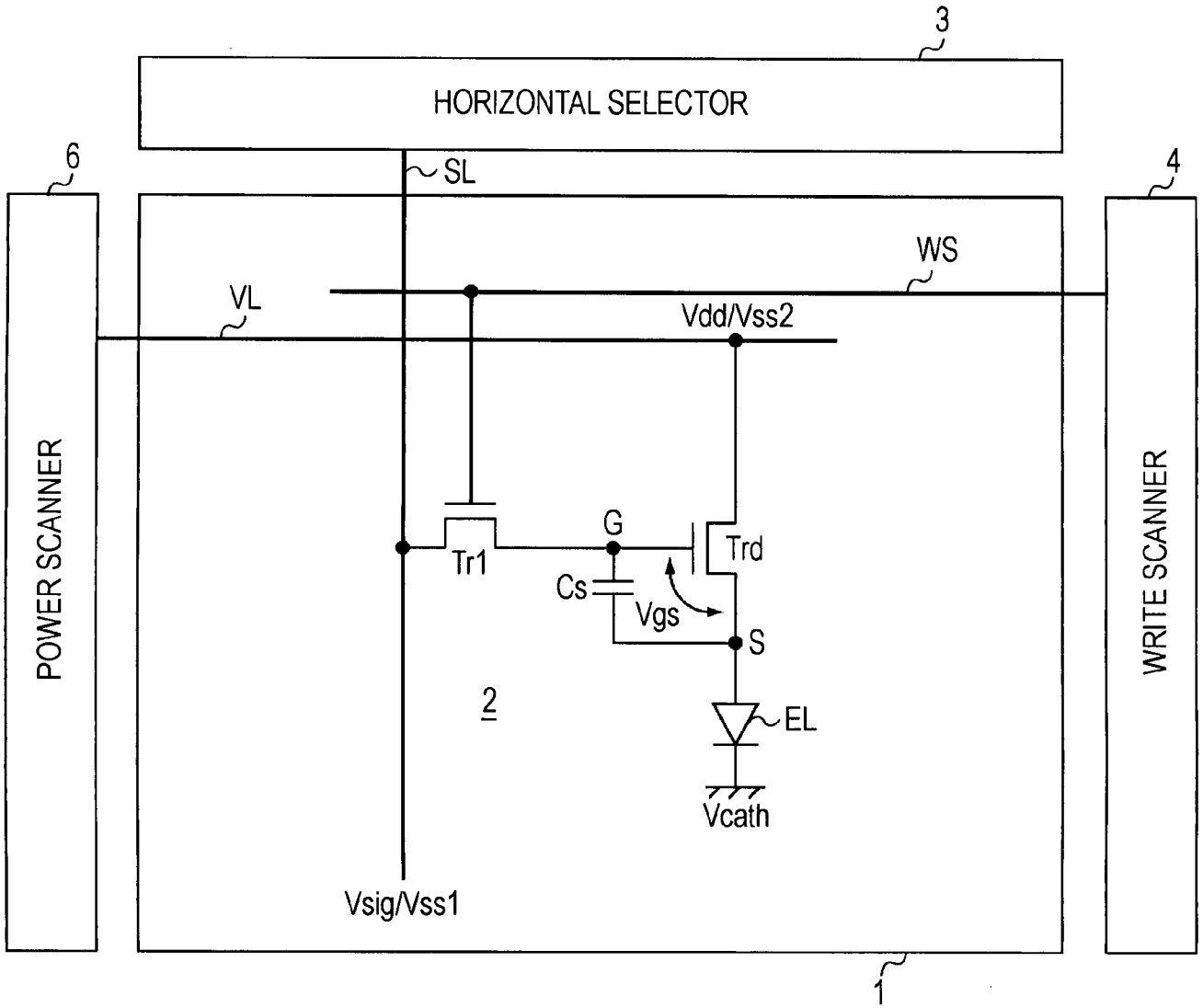
FIG. 2 is a circuit diagram of the specific structure of the display device shown in FIG. 1.

FIG. 2 is a circuit diagram showing the specific structure and connection relationship in each of the pixels 2 included in the display device shown in FIG. 1. As shown in FIG. 2, the pixel 2 includes a light-emitting element EL, which is represented by an organic EL device, a sampling transistor Tr1, a drive transistor Trd, and a storage capacitor Cs. The sampling transistor Tr1 has a control end (gate) connected to a corresponding one of the scanning lines WS and a pair of current ends (source and drain), one current end being connected to a corresponding one of the signal lines SL, and the other current end being connected to a control end (gate G) of the drive transistor Trd. The drive transistor Trd has a pair of current ends (source S and drain), one current end being connected to the light-emitting element EL, and the other current end being connected to a corresponding one of the power lines VL. In this example, the drive transistor Trd is an N-channel type. The drain of the drive transistor Trd is connected to the power line VL, and the source S of the drive transistor Trd is connected to the anode of the light-emitting element EL, which serves as an output node. The cathode of the light-emitting element EL is connected to a predetermined cathode potential Vcath. The storage capacitor Cs is connected between the source S, which is one of the current ends of the drive transistor Trd, and the gate G, which is the control end of the drive transistor Trd.

With the foregoing structure, an electrical connection is established with the sampling transistor Tr1 in accordance with a control signal supplied from the scanning line WS, and the sampling transistor Tr1 samples and holds a signal potential supplied from the signal line SL in the storage capacitor Cs. The drive transistor Trd receives a current supplied from the power line VL at the first potential (high potential Vdd) and allows a drive current in accordance with the signal potential held in the storage capacitor Cs to flow through the light-emitting element EL. In order to establish an electrical connection with the sampling transistor Tr1 for a period of time in which the signal line SL is at the signal potential, the write scanner 4 outputs a control signal with a predetermined pulse width to the scanning line WS, thereby holding the signal potential in the storage capacitor Cs and, at the same time, applying a correction to the signal potential with respect to a mobility μ of the drive transistor Trd. After that, the drive transistor Trd supplies a drive current in accordance with the signal potential Vsig written in the storage capacitor Cs to the light-emitting element EL, and the light-emitting element EL starts a light-emitting operation.

Besides the foregoing mobility correcting function, the pixel 2 has a threshold-voltage correcting function. That is, the power scanner 6 switches the power line VL from the first potential (high potential Vdd) to the second potential (low potential Vss2) at a first time before the sampling transistor Tr1 samples the signal potential Vsig. Similarly, before the sampling transistor Tr1 samples the signal potential Vsig, the write scanner 4 establishes an electrical connection with the sampling transistor Tr1 at a second time, applies a reference potential Vss1 from the signal line SL to the gate G of the drive transistor Trd, and sets the source S of the drive transistor Trd to the second potential (Vss2). At a third time after the second time, the power scanner 6 switches the power line VL from the second potential Vss2 to the first potential Vdd and holds a voltage corresponding to a threshold voltage Vth of the drive transistor Trd in the storage capacitor Cs. With this threshold-voltage correcting function, the display device can cancel the influence of the threshold voltage Vth of the drive transistor Trd, which varies from one pixel 2 to another.

The pixel 2 further includes a bootstrap function. That is, the write scanner 4 cancels the application of a control signal to the scanning line WS at a time when the signal potential Vsig is held in the storage capacitor Cs, thereby breaking the electrical connection with the sampling transistor Tr1. The gate G of the drive transistor Trd is electrically disconnected from the signal line SL. Thus, the potential of the gate G becomes associated with a change in the potential of the source S of the drive transistor Trd, and a voltage Vgs between the gate G and the source S can be maintained constant.

Figure 3:
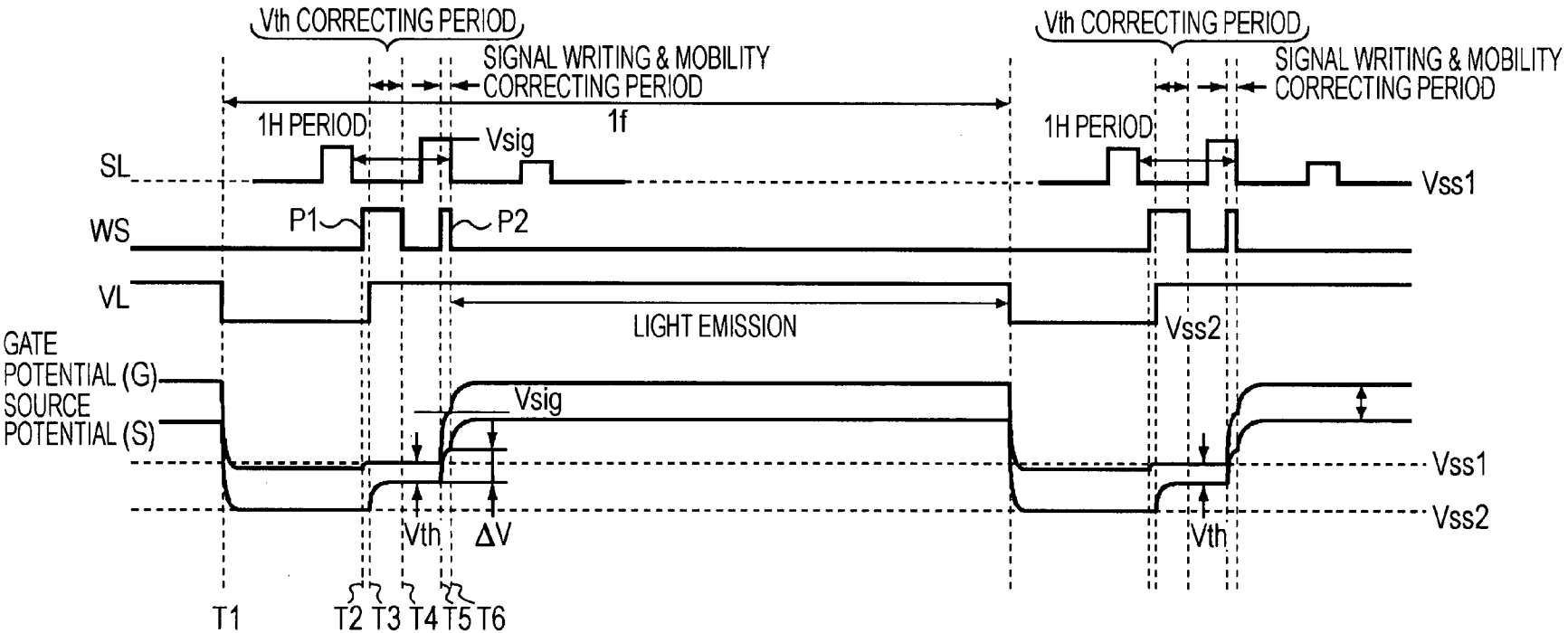
FIG. 3 is a timing chart for describing the operation of the display device shown in FIG. 2.

FIG. 3 is a timing chart for describing the operation of the pixel 2 shown in FIG. 2. The timing chart has a common time axis and illustrates changes in the potentials of the scanning line WS, the power line VL, and the signal line SL. In parallel to these potential changes, changes in the potentials of the gate G and the source S of the drive transistor Trd also are illustrated.

A feature of the embodiment of the present invention is that a control signal pulse for turning the sampling transistor Tr1 on is applied to the scanning line WS. This control signal pulse is applied to the scanning line WS on a field-by-field (1*f*) basis in accordance with line-sequential scanning of the pixel array section 1. The control signal pulse includes two pulses in one horizontal scanning period (1H). Hereinafter, the first pulse may be referred to as a first pulse P1, and the second pulse may be referred to as a second pulse P2. The power line VL is switched between the high potential Vdd and the low potential Vss2 similarly on a field-by-field (1*f*) basis. A drive signal switched between the signal potential Vsig and the reference potential Vss1 in each horizontal scanning period (1H) is supplied to the signal line SL.

As shown in the timing chart of FIG. 3, the pixel 2, which has been in an emission period in the previous field, enters a non-emission period in the current field and then enters an emission period in the current field. In the non-emission period, the pixel 2 performs a preparation operation, a threshold-voltage correcting operation, a signal writing operation, a mobility correcting operation, and the like.

In the emission period in the previous field, the power line VL is at the high potential Vdd, and the drive transistor Trd supplies a drive current Ids to the light-emitting element EL. The drive current Ids flows from the power line VL, which is at the high potential Vdd, through the drive transistor Trd the light-emitting element EL, and into the cathode line.

Next, in the non-emission period in the current field, the power line VL is switched from the high potential Vdd to the low potential Vss2 at time T1. This enables the power line VL to be discharged to Vss2, and the potential of the source S of the drive transistor Trd decreases to Vss2. As a result, the anode potential of the light-emitting element EL (that is, the source potential of the drive transistor Trd) is in a reverse-bias state. No drive current is allowed to flow, and light is turned off. In association with this decrease in the potential of the source S of the drive transistor Trd, the potential of the gate G also decreases.

Next, at time T2, the scanning line WS is switched from a low level to a high level, and this establishes an electrical connection with the sampling transistor Tr1. At this point, the signal line SL is at the reference potential Vss1. The potential of the gate G of the drive transistor Trd becomes the reference potential Vss1 of the signal line SL through the electrically connected sampling transistor Tr1. At this point, the potential of the source S of the drive transistor Trd is the potential Vss2, which is sufficiently lower than Vss1. In this manner, the voltage Vgs between the gate G and the source S of the drive transistor Trd is initialized so as to be greater than the threshold voltage Vth of the drive transistor Trd. The period T1-T3, from time T1 to time T3, is a preparation period in which the voltage Vgs between the gate G and the source S of the drive transistor Trd is set in advance to Vth or greater.

Next, at time T3, the power line VL is switched from the low potential Vss2 to the high potential Vdd, and the potential of the source S of the drive transistor Trd starts increasing. When the voltage Vgs between the gate G and the source S of the drive transistor Trd becomes the threshold voltage Vth, the current is cut off. In this manner, a voltage corresponding to the threshold voltage Vth of the drive transistor Trd is written into the storage capacitor Cs. This is the threshold-voltage correcting operation. In order for the current to mostly flow into the storage capacitor Cs and not to the light-emitting element EL, the cathode potential Vcath is set so that the light-emitting element EL is cut off.

At time T4, the scanning line WS is changed from the high level back to the low level. In other words, the first pulse P1 applied to the scanning line WS is cancelled, and the sampling transistor Tr1 is turned off. As is clear from the above description, the first pulse P1 is applied to the gate of the sampling transistor Tr1 in order to perform the threshold-voltage correcting operation.

Thereafter, the signal line SL is switched from the reference potential Vss1 to the signal potential Vsig. At time T5, the scanning line WS again rises from the low level to the high level. In other words, the second pulse P2 is applied to the gate of the sampling transistor Tr1. As a result, the sampling transistor Tr1 is turned on again, and the sampling transistor Tr1 samples the signal potential Vsig from the signal line SL. Thus, the potential of the gate G of the drive transistor Trd becomes the signal potential Vsig. Since the light-emitting element EL is in a cut-off state (high-impedance state) at the beginning, the current flowing between the drain and the source S of the drive transistor Trd mostly flows into the equivalent capacitance of the storage capacitor Cs and the light-emitting element EL, and charging thus begins. The potential of the source S of the drive transistor Trd increases by ΔV by time T6 at which the sampling transistor Tr1 is turned off. In this manner, the signal potential Vsig of a video signal is added to Vth and written into the storage capacitor Cs, and the voltage ΔV for mobility correction is subtracted from the voltage held in the storage capacitor Cs. Therefore, the period T5-T6, from time T5 to time T6, is the signal writing period and the mobility correcting period. In other words, when the second pulse P2 is applied to the scanning line WS, the signal writing operation and the mobility correcting operation are performed. This signal writing and mobility correcting period T5-T6 is equal to the pulse width of the second pulse P2. That is, the pulse width of the second pulse P2 defines the mobility correcting period.

In this manner, the writing of the signal potential Vsig and the adjustment of the correction amount ΔV are simultaneously performed in the signal writing period T5-T6. The higher the signal potential Vsig, the larger the current Ids supplied by the drive transistor Trd, and the larger the absolute value of ΔV. Thus, a mobility correction according to the luminance level of light emission is performed. If Vsig is constant, the larger the mobility μ of the drive transistor Trd, and the larger the absolute value of ΔV. In other words, the larger the mobility μ, the larger the negative feedback ΔV to the storage capacitor Cs. Therefore, variations in the mobility ΔV among the pixels 2 can be removed.

Finally, at time T6, as has been described above, the scanning line WS changes to the low level, and the sampling transistor Tr1 is turned off. As a result, the gate G of the drive transistor Trd is disconnected from the signal line SL. At the same time, the drain current Ids starts flowing through the light-emitting element EL. As a result, the anode potential of the light-emitting element EL increases in accordance with the drive current Ids. This increase in the anode potential of the light-emitting element EL is nothing less than an increase in the potential of the source S of the drive transistor Trd. When the potential of the source S of the drive transistor Trd increases, due to the bootstrap operation of the storage capacitor Cs, the potential of the gate G of the drive transistor Trd also increases. The amount of increase in the gate potential is equal to the amount of increase in the source potential. Thus, the voltage Vgs between the gate G and the source S of the drive transistor Trd is maintained constant in the emission period. The value of Vgs is the signal potential Vsig with the correction of the threshold voltage Vth and the correction of the mobility μ. The drive transistor Trd operates in a saturation region. That is, the drive transistor Trd supplies the drive current Ids in accordance with the voltage Vgs between the gate G and the source S. The value of Vgs is the signal potential Vsig with the correction of the threshold voltage Vth and the correction of the mobility μ.

Figure 4:
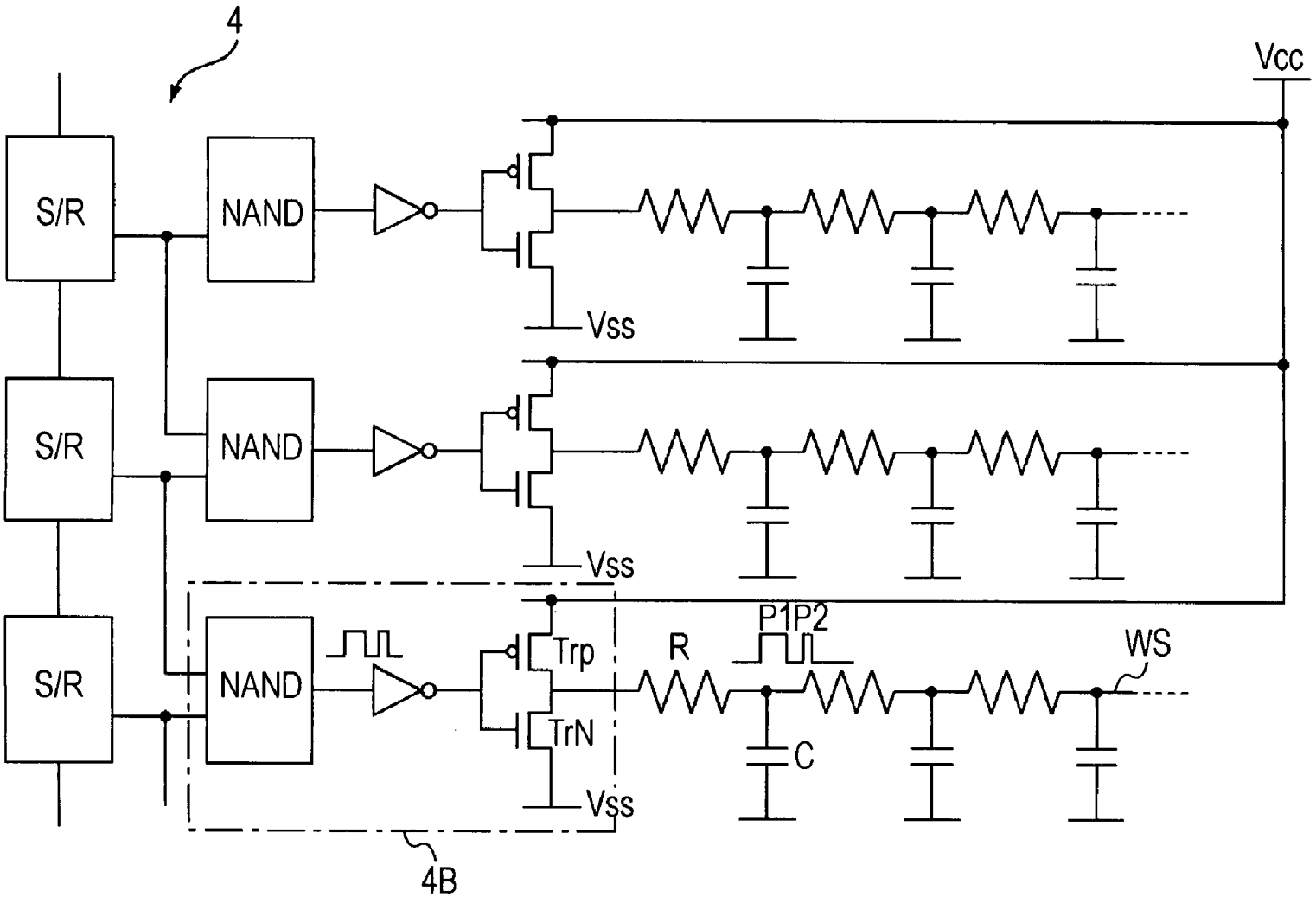
FIG. 4 is a circuit diagram showing a first reference example of a write scanner included in a peripheral drive section of the display device.

FIG. 4 is a circuit diagram schematically illustrating a first reference example of the write scanner 4 shown in FIGS. 1 and 2. FIG. 4 schematically illustrates three stages of an output section of the write scanner 4 and three rows (three lines) of the pixel array section 1 connected to the three output stages.

The write scanner 4 includes shift registers S/R. The write scanner 4 operates in accordance with a clock signal supplied from the outside. The write scanner 4 sequentially transfers a start signal similarly input from the outside and outputs a sequential signal on a stage-by-stage basis. The shift/register S/R at each stage is connected to a corresponding one of NAND elements, which are part of output buffers 4B. Each of the NAND elements performs NAND processing of the sequential signal output from the S/R at the adjacent stage and generates a rectangular waveform serving as the base of a control signal. The rectangular waveform is input via an inverter to another inverter serving as an output section of each of the output buffers 4B. Each of the output buffers 4B operates in accordance with an input signal supplied from a corresponding one of the shift registers S/R and supplies a final control signal to a corresponding one of the scanning lines WS in the pixel array section 1. As shown in FIG. 4, the control signal output to the scanning line WS includes two pulses P1 and P2.

The output section of the output buffer 4B includes a pair of switching elements connected in series between a power supply potential Vcc and a ground potential Vss. In this reference example, the output section constitutes an inverter. One switching element is a P-channel transistor TrP (typically a P metal-oxide-semiconductor (PMOS) transistor), and the other switching element is an N-channel transistor TrN (typically an NMOS transistor). Each line in the pixel array section 1 connected to a corresponding one of the output buffers 4B is represented as resistance components R and capacitance components C in terms of equivalent circuit elements.

The output section constituting the inverter outputs a control signal having a rectangular pulse since the P-channel transistor TrP and the N-channel transistor TrN are alternately turned on. When the P-channel transistor TrP is turned on, an output node of the inverter is suddenly boosted to the power supply potential Vcc. That is, the P-channel transistor TrP mainly forms the rising waveform of a control signal. In contrast, when the N-channel transistor TrN of the inverter is turned on, the output node of the inverter is suddenly reduced to the ground line Vss. In other words, the N-channel transistor TrN of the inverter mainly forms the falling waveform of the control signal.

The control signal supplied from the output buffer 4B in the write scanner 4 includes the first pulse P1 and the second pulse P2. As has been described above, the first pulse P1 is output during the Vth correcting operation, and the pulse width of the first pulse P1 defines the Vth correcting period. The second pulse P2 is output during the mobility correcting operation, and the pulse width of the second pulse P2 defines the mobility correcting period. In general, the Vth correcting period is on the order of a few tens of microseconds and is not necessary to be very accurately controlled. In contrast, the mobility correcting period is generally very short (a few microseconds) and must be accurately controlled. If the mobility correcting period varies among lines, the correction amount ΔV varies among lines. As a result, the luminance varies among lines. This causes horizontal streaks on the screen, and the quality of an image is degraded.

The second pulse P2 basically has a rectangular waveform, and the pulse width of the second pulse P2 ought not to vary. Actually, however, the rising and falling waveforms of the pulse P2 are blurred, and the effective pulse width varies. If transistors constituting the output buffer 4B at each stage have variations in characteristics, the waveform of the pulse P2 is blurred, resulting in a deterioration of the accuracy. The first reference example shown in FIG. 4 shows a simple inverter structure outputting the rectangular pulses P1 and P2. Thus, the blurring of the waveform varies among stages, resulting in a deterioration of the accuracy. In particular, a reduction in the accuracy of the second pulse P2 appears as streaks on the screen, which may degrade the quality of an image.

Figure 5:
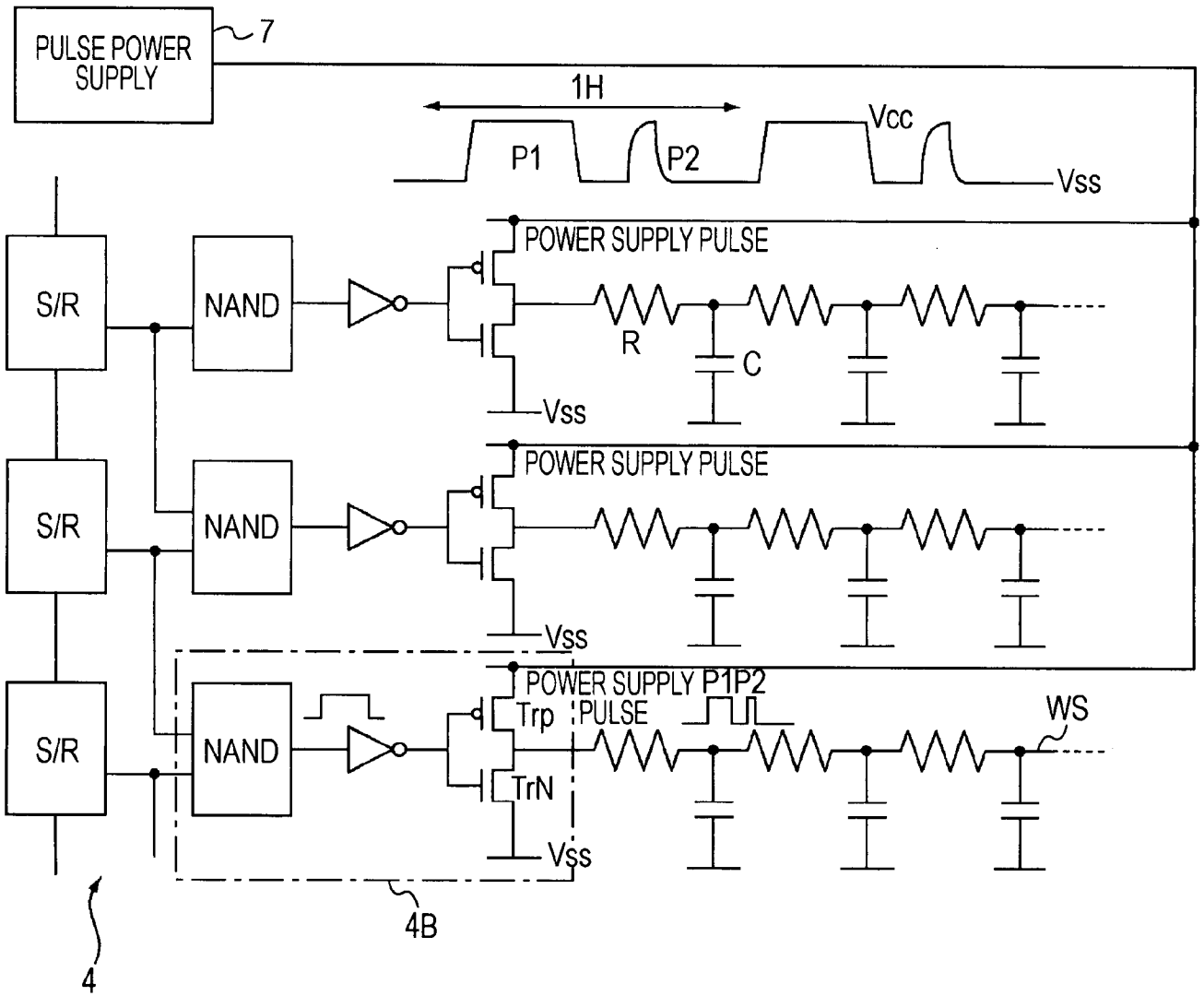
FIG. 5 is a circuit diagram showing a second reference example of the same.

FIG. 5 is a circuit diagram schematically illustrating a second reference example of the write scanner 4. In order to enhance understanding, portions corresponding to those in the first reference example of the write scanner 4 shown in FIG. 4 are given the same reference numerals. The difference is that a pulse power supply 7 is connected to a power line of the output buffer 4B at each stage. The pulse power supply 7 operates in synchronization with the write scanner 4 and supplies a power supply pulse string including the first pulse P1 and the second pulse P2 to the power line of the output buffer 4B. In contrast, the output buffer 4B is turned on in accordance with a gate pulse output from a corresponding one of the shift registers S/R, extracts the two power supply pulses P1 and P2 supplied from the power line, and outputs the power supply pulses P1 and P2 as they are to the scanning line WS.

The pulses P1 and P2 supplied from the pulse power supply 7 have stable waveforms. The output buffer 4B at any stage extracts the stable and highly accurate pulses P1 and P2 and outputs the pulses P1 and P2 to a corresponding one of the scanning lines WS without changing the pulses P1 and P2. Therefore, the second reference example shows no large difference in the pulse width of the second pulse P2 among stages, and variations in the mobility correcting period are suppressed. Thus, horizontal streaks do not appear on the screen, and the quality of an image can be improved.

Figure 6:
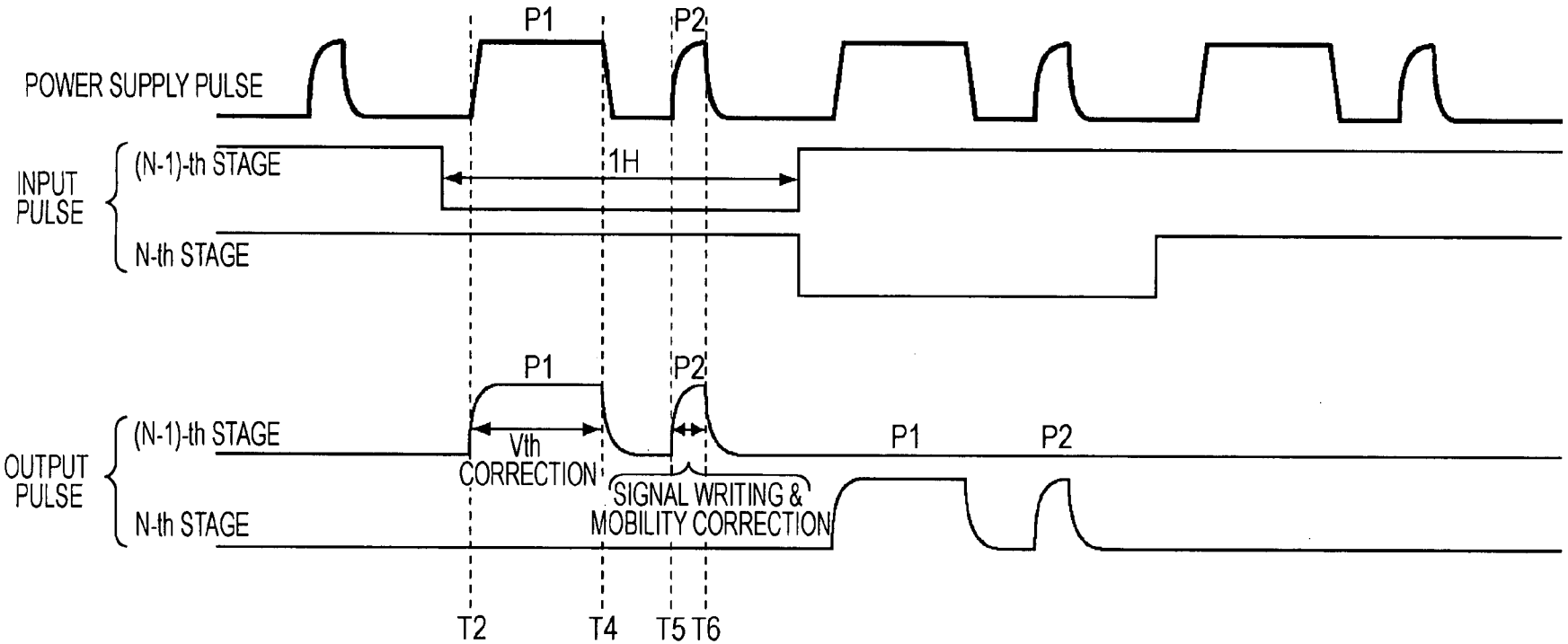
FIG. 6 is a waveform diagram for describing the operation of the second reference example.

FIG. 6 is a timing chart for describing the operation of the write scanner 4 according to the second reference example shown in FIG. 5. As shown in FIG. 6, the pulse power supply 7 supplies a power supply pulse string including the two pulses P1 and P2 to the power line of the output buffer 4B in each horizontal scanning period (1H). The timing chart in FIG. 6 illustrates an input pulse and an output pulse of the inverter constituting the final output section of each output buffer 4B using the same time series as the power supply pulse. FIG. 6 illustrates input pulses supplied to the output buffers 4B at a (N−1)-th stage and a N-th stage, and output pulses of the output buffers 4B at the (N−1)-th stage and N-th stage. Each input pulse is a rectangular pulse shifted stage by stage in each horizontal scanning period (1H). When the input pulse is supplied to the output buffer 4B at the (N−1)-th stage, the inverter is turned on and extracts the two pulses P1 and P2 from the power line. These pulses P1 and P2 become an output pulse of the output buffer 4B at the (N−1)-th stage, and the output pulse including the pulses P1 and P2 is output to the (N−1)-th scanning line WS. Similarly, when an input pulse is applied to the output buffer 4B at the N-th stage, the two output pulses P1 and P2 are output from the output buffer 4B at the N-th stage to the corresponding (N-th) scanning line WS.

The first pulse P1 output on a stage-by-stage basis defines the Vth correcting period from time T2 to time T4. The second pulse P2 output on a stage-by-stage basis defines the signal writing and mobility correcting period from time T5 to time TG. The second pulse P2 output on a stage-by-stage basis is obtained by extracting the pulse P2 from the power supply pulse string in each horizontal scanning period (1H) and outputting the pulse P2 without changing the pulse P2. There are no large differences in the pulse width of the pulse P2 among stages. Therefore, the mobility correcting period T5-T6 is maintained constant among lines, and a deterioration in the quality of an image, such as horizontal streaks, does not occur.

However, since the two pulses P1 and P2 are output in each horizontal scanning period (1H) in the second reference example shown in FIG. 6, the pulse power supply 7 is necessary to perform charging and discharging two times in each horizontal scanning period (1H). This doubles the power consumption of each output buffer 4B of the write scanner 4. The higher the definition of the panel, the larger the number of scanning lines. This causes a further increase in the power consumption. Therefore, it is an urgent task to reduce the power consumption of each output buffer 4B of the write scanner 4 due to an increase in the definition of the panel.

Figure 7A:
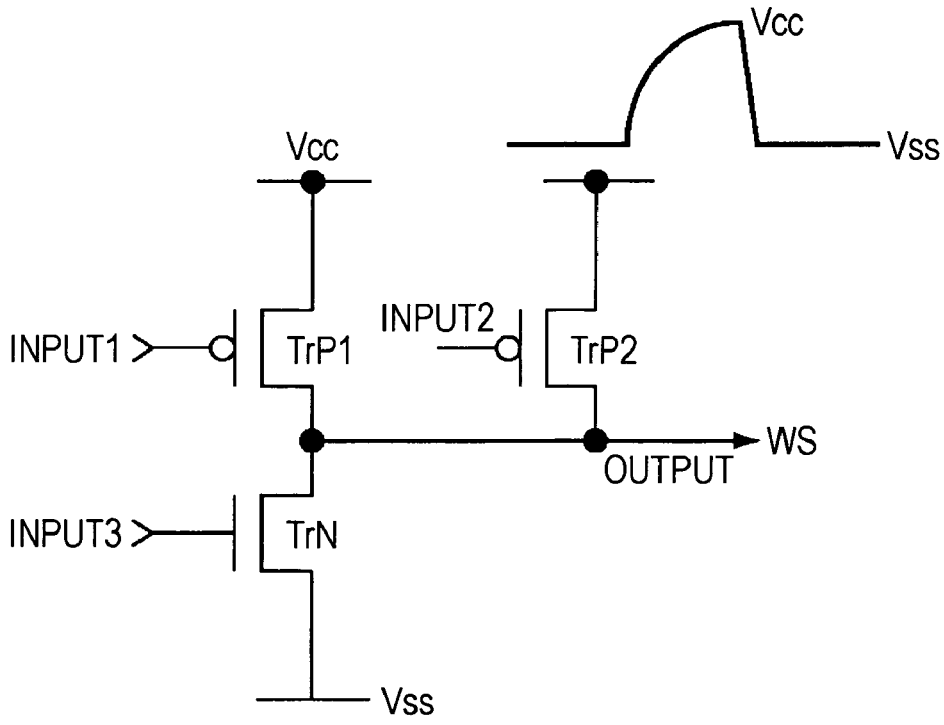
FIGS. 7A and 7B are circuit diagrams of a write scanner included in a display device according to embodiments of the present invention.
Figure 7B:
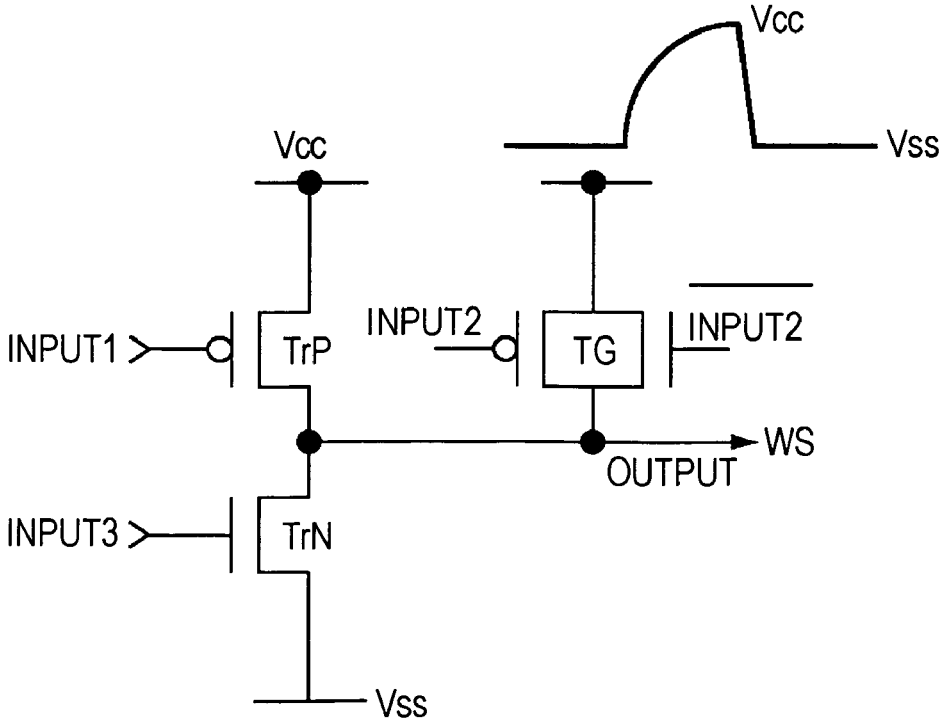

FIGS. 7A and 7B are circuit diagrams schematically showing a write scanner according to embodiments of the present invention. More specifically, FIGS. 7A and 7B show an output buffer portion of the write scanner. FIG. 7A shows a first embodiment, and FIG. 7B shows a second embodiment. With reference to the first embodiment, the output buffer of the write scanner outputs a control signal including two pulses in one horizontal scanning period (1H) to a corresponding one of the scanning lines WS. The output buffer includes a first output section connected to a fixed potential Vcc and a second output section connected to a pulse power supply. The first output section outputs one of the two pulses. The second output section extracts a pulse supplied from the pulse power supply and outputs the extracted pulse as the other one of the two pulses.

In the first embodiment, the first output section includes a P-channel transistor TrP1, and the second output section similarly includes a P-channel transistor TrP2. The source of the first P-channel transistor TrP1 is connected to the power supply Vcc, and the drain of the first P-channel transistor TrP1 is connected to an output terminal. A first input signal (input1) is applied to the gate of the first P-channel transistor TrP1. The drain of an N-channel transistor TrN is connected to the drain of the first P-channel transistor TrP1. The source of the N-channel transistor TrN is connected to the ground line Vss. A third input signal (input3) is applied to the gate of the N-channel transistor TrN. The first P-channel transistor TrP1 and the N-channel transistor TrN constitute an inverter. This portion has the same structure as the output section in the first reference example shown in FIG. 4.

The source of the second P-channel transistor TrP2 is connected to the pulse power supply, and the drain of the second P-channel transistor TrP2 is connected to the output terminal. A second input signal (input2) is applied to the gate of the second P-channel transistor TrP2. The second P-channel transistor TrP2 and the N-channel transistor TrN constitute an inverter. This portion has the same structure as the output section in the second reference example shown in FIG. 5. As can be understood from the above description, the first embodiment shown in FIG. 7A is a hybrid type combining the first reference example and the second reference example.

Basically, the second embodiment shown in FIG. 7B has a structure similar to that of the first embodiment shown in FIG. 7A. The difference is that a switching element constituting the second output section is replaced from the second P-channel transistor TrP2 to a transmission gate element TG. It is necessary for the second output section to extract a pulse supplied from the pulse power supply and to output the extracted pulse to a corresponding one of the scanning lines WS without distorting the extracted pulse. To this end, the transmission gate element TG, which serves as a switching element with excellent linearity, is used. Since the transmission gate element TG includes a pair of a P-channel transistor and an N-channel transistor, the number of elements at each stage is increased by one transistor, as compared with the first embodiment shown in FIG. 7A.

Figure 8:
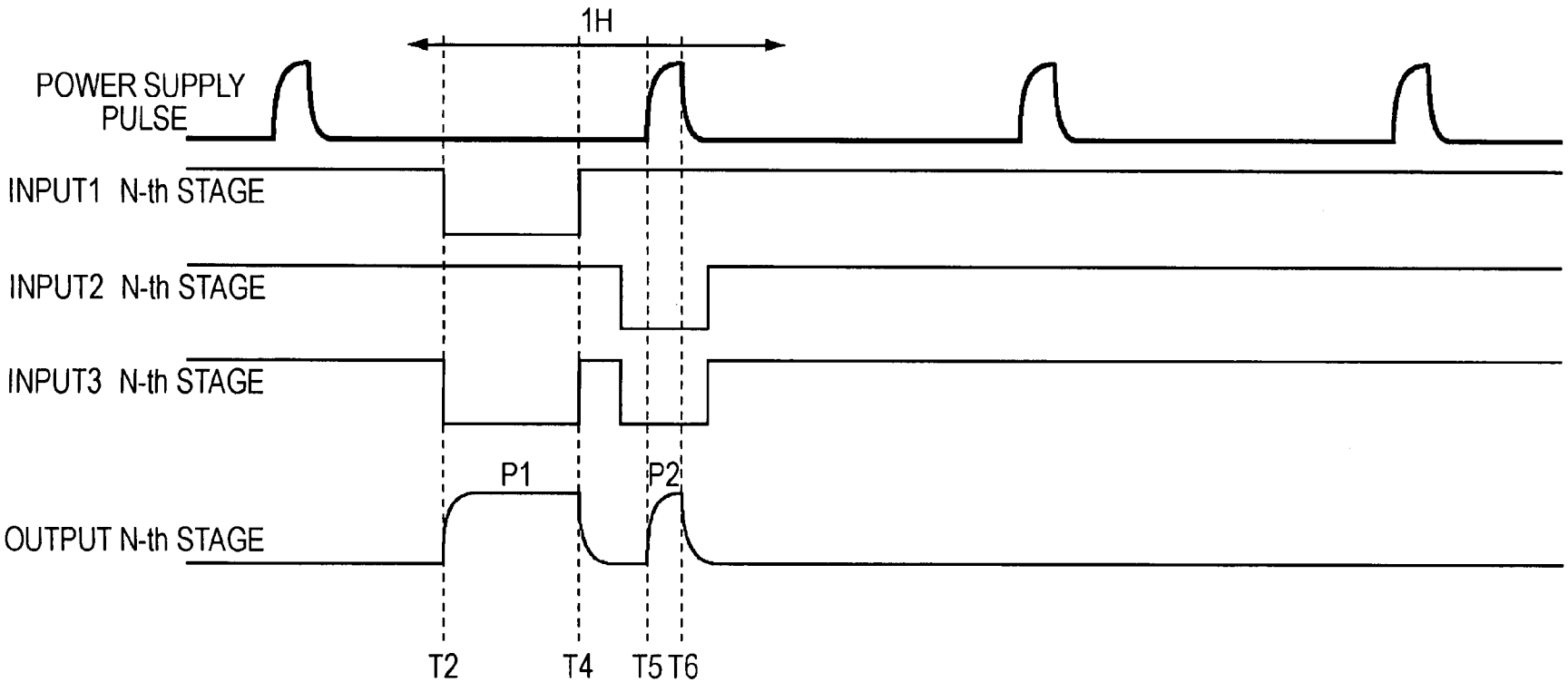
FIG. 8 is a waveform diagram for describing the operation of the write scanner shown in FIGS. 7A and 7B.

FIG. 8 is a timing chart for describing the operation of the output buffer according to the first and second embodiments shown in FIGS. 7A and 7B. A power supply pulse supplied from the pulse power supply 7 includes one pulse per horizontal scanning period (1H). Since it is only necessary for the pulse power supply 7 to perform a charging/discharging operation one time per horizontal scanning period (1H), the power consumption can be reduced substantially by half, as compared with the foregoing second reference example.

The timing chart in FIG. 8 illustrates the waveforms of the first, second, and third input signals (input1, input2, and input3) and the output signal of the output buffer using the same time series as the power supply pulse. The first input signal (input1) is input to the first P-channel transistor TrP1 connected to the fixed power supply Vcc. In response to this, the first pulse P1 is output. The first pulse P1 is used to correct Vth. The second input signal (input2) is input to the second P-channel transistor TrP2 connected to the pulse power supply 7. The second P-channel transistor TrP2 extracts a pulse supplied from the pulse power supply 7 and outputs the extracted pulse as the second pulse P2 to the corresponding (N-th) scanning line WS. The second pulse P2 is used to write the signal potential and to correct the mobility. The first input signal (input1) and the second input signal (input2) are alternately input in one horizontal scanning period (1H) and do not overlap each other with respect to time. The third input signal (input3) is input to the N-channel transistor TrN. Since the N-channel transistor TrN must be turned off in a period when the two P-channel transistors TrP1 and TrP2 are turned on, the third input signal (input3) has a waveform combining the first input signal (input1) and the second input signal (input2).

As has been described above, the Vth correcting period is on the order of a few tens of microseconds. Since it is only necessary to cut the drive transistor off in the Vth correcting period, a very high accuracy with respect to time is unnecessary. If the time width and phase of the first pulse P1 supplied from the output buffer of the write scanner have variations, there are no serious problems. According to the embodiment of the present invention, the first pulse P1 is not extracted from the pulse power supply 7, but is formed by an inverter connected to the general fixed power supply. In contrast, in the mobility correcting period, variations in the phase of the second pulse P2 are not allowed, partly because of the relationship with a drive signal. The time width of the second pulse P2 must be accurately controlled on the order of a few microseconds. According to the embodiment of the present invention, a pulse supplied from the pulse power supply 7 is extracted and output to a corresponding one of the scanning lines WS without changing the pulse. Accordingly, variations in the phase and the time width of the second pulse P2 can be suppressed, and the mobility correcting period T5-T6 can be set to an optimal period of time. According to the embodiment of the present invention described above, in the buffer at the final stage of the write scanner, the first pulse P1 for correcting Vth is formed using the fixed power supply, and the second pulse P2 for correcting the mobility is formed by extracting a power supply pulse. Thus, it is only necessary for the pulse power supply 7 to output one pulse in each horizontal scanning period (1H), and the number of charging/discharging operations can be reduced. Thus, the power consumption of a panel module can be significantly reduced. At the same time, variations in the mobility correcting time are suppressed, thereby achieving a high uniformity.

Figure 9A:
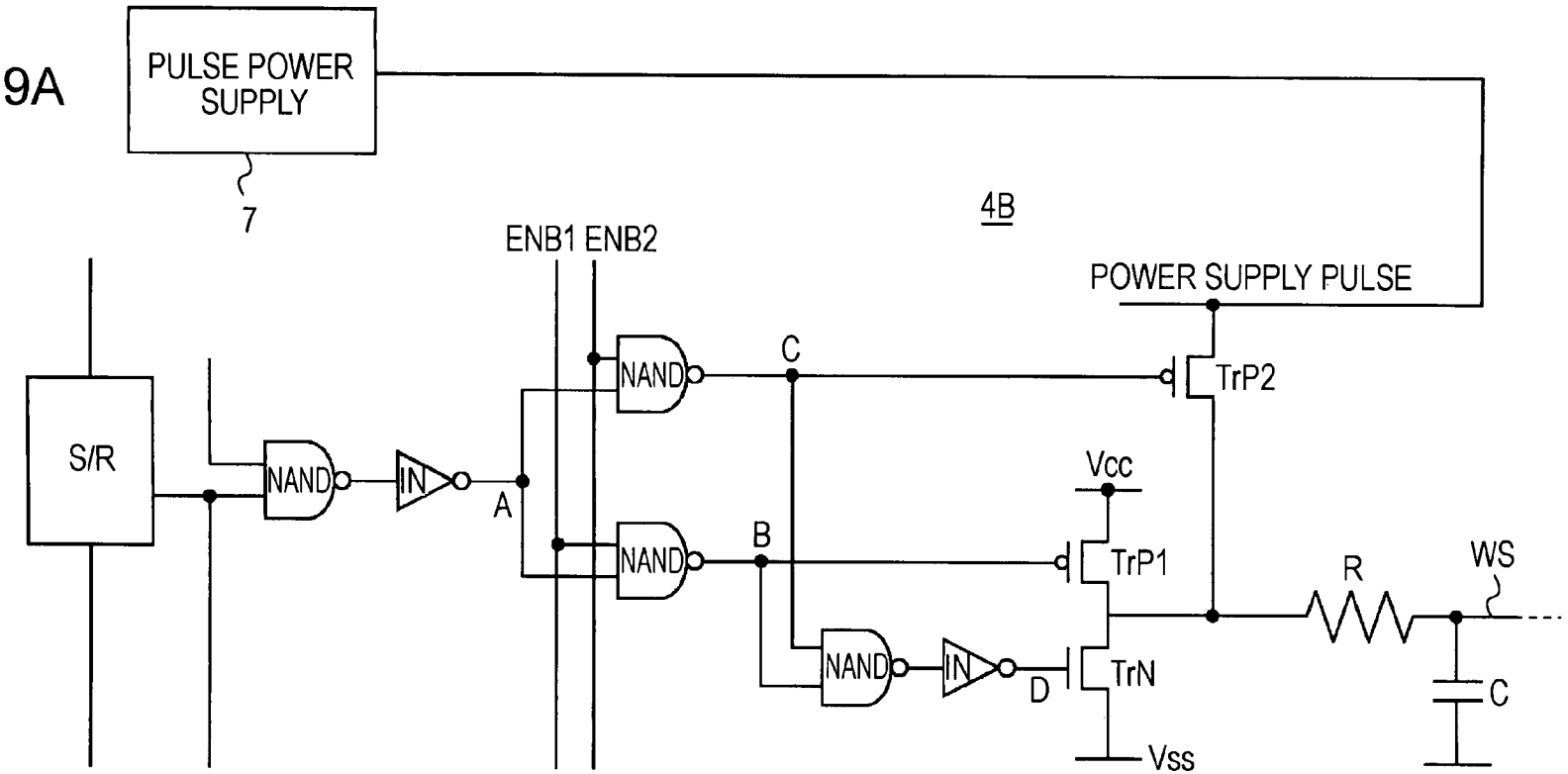
FIG. 9A is a circuit diagram of a specific example of a write scanner according to an embodiment of the present invention.
Figure 9B:
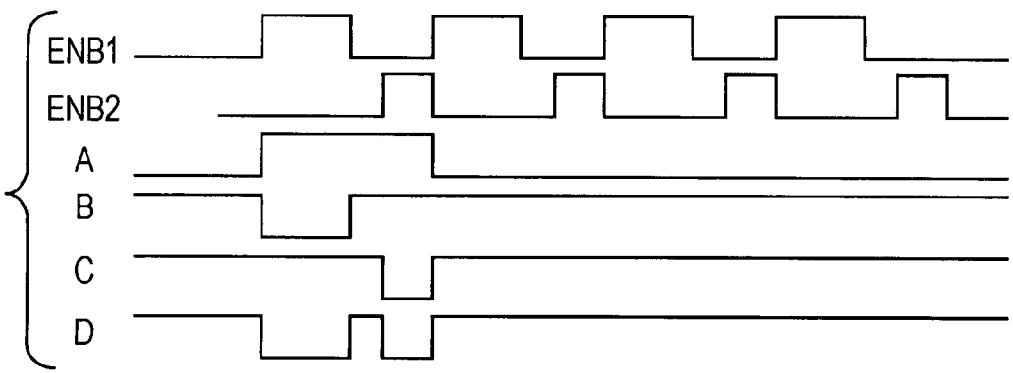
FIG. 9B illustrates waveforms observed at nodes A, B, C, and D on the circuit.

FIG. 9A is a circuit diagram of the specific circuit structure of a write scanner including the output buffer shown in FIG. 7A. In order to enhance understanding, one stage of the write scanner is illustrated. Furthermore, FIG. 9B illustrates waveforms observed at nodes A, B, C, and D on the circuit. Control signals ENB1 and ENB2 applied to a pair of NAND gate elements NANDs are signals for controlling the timing of the threshold-voltage correcting operation and the mobility correcting operation and are input from the outside of the display panel in each horizontal scanning period (1H).

Figure 10:
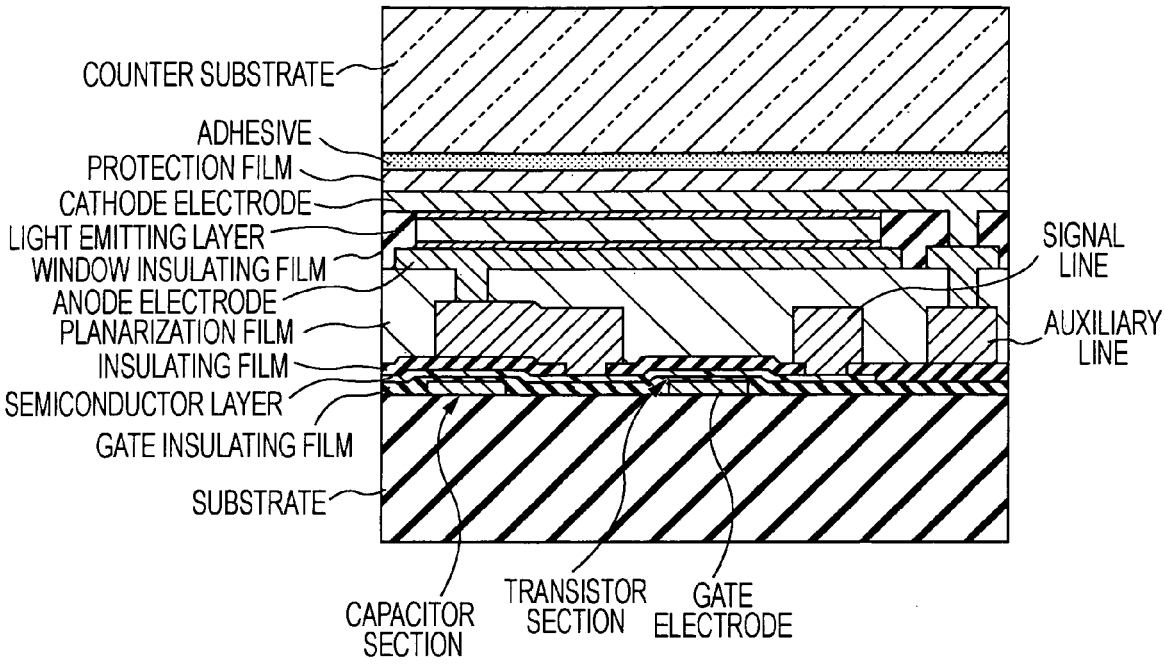
FIG. 10 is a sectional view of a device structure of the display device.

The display device according to the embodiment of the present invention has a thin-film device structure shown in FIG. 10. FIG. 10 schematically shows a sectional structure of a pixel formed on an insulating substrate. As shown in FIG. 10, the pixel includes a transistor section including a plurality of TFTs (only one TFT is shown in FIG. 10), a capacitor section including a storage capacitor or the like, and a light-emitting section including an organic EL device or the like. On the substrate, the transistor section and the capacitor section are formed using a TFT process, and the light-emitting section including the organic EL device or the like is stacked thereon. This structure is bonded to a transparent counter substrate with an adhesive provided therebetween, whereby a flat panel is configured.

Figure 11:
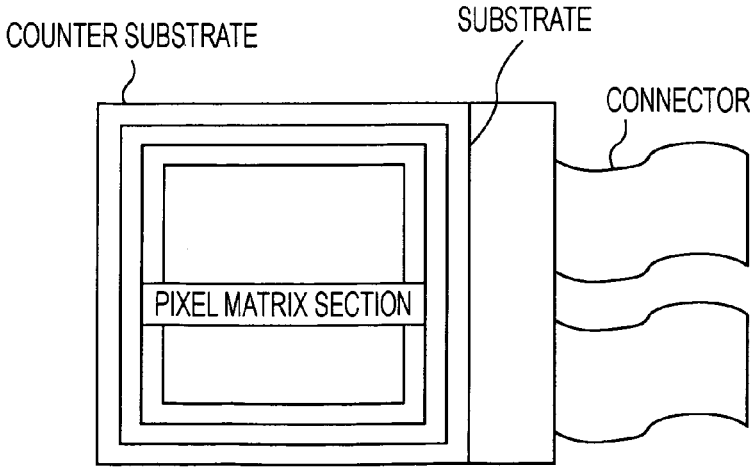
FIG. 11 is a plan view of a module structure of the display device.

The display device according to the embodiment of the present invention includes a flat module shape shown in FIG. 11. For example, a pixel array section including pixels arranged in a matrix is provided on an insulating substrate. Each pixel includes an organic EL device, a TFT, a thin-film capacitor, and the like. An adhesive is provided to surround the pixel array section (pixel matrix section). This structure is bonded to a counter substrate made of glass or the like, whereby a display module is configured. This transparent counter substrate may include, if necessary, a color filter, a protection film, a light-shielding film, and the like. The display module may also include, for example, a flexible printed circuit (FPC) as a connector for inputting and outputting signals to/from the outside of the pixel array section.

The foregoing display device according to the embodiment of the present invention has a flat panel shape and is applicable to displays of electronic apparatuses in various fields for displaying a drive signal input thereto or generated therein as an image or a video image. The electronic apparatuses include, for example, digital cameras, notebook personal computers, cellular phones, video cameras, and the like. Exemplary electronic apparatuses to which such a display device is applied will be described below.

Figure 12:
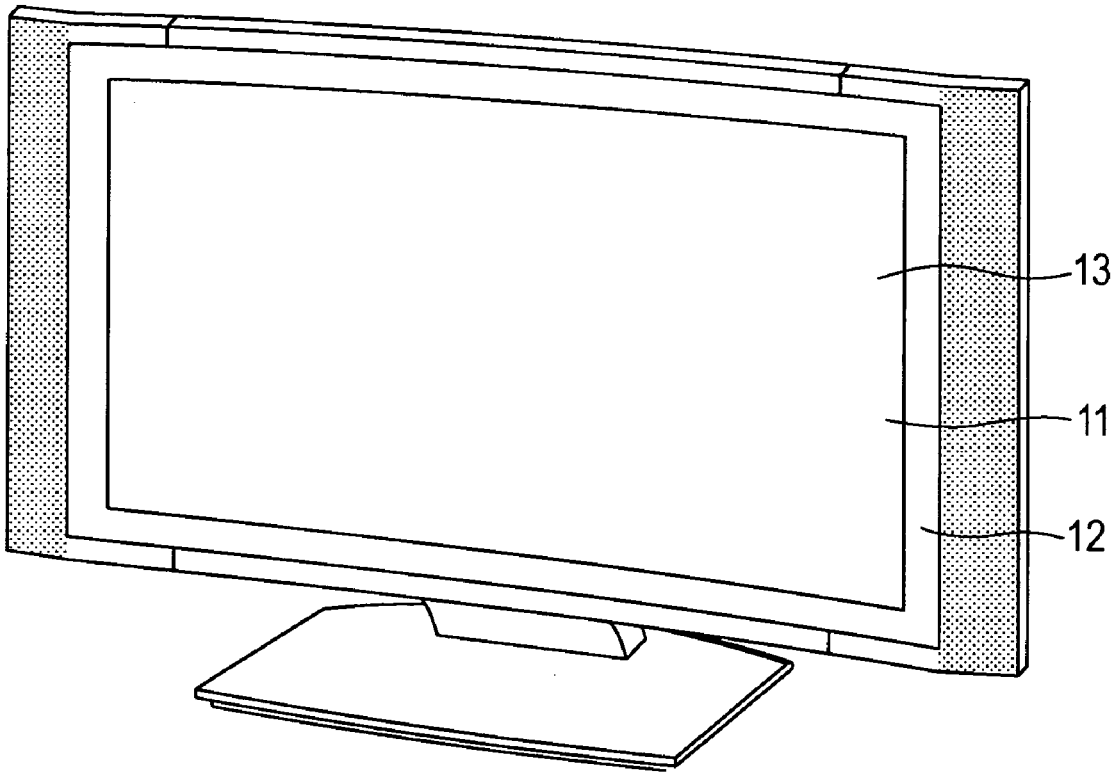
FIG. 12 is a perspective view of a television set having the display device according to the embodiment of the present invention.

FIG. 12 illustrates a television set to which the embodiment of the present invention is applied. The television set includes a video display screen 11 including a front panel 12, a filter glass 13, and the like. The television set is fabricated by using the display device according to the embodiment of the present invention as the video display screen 11.

Figure 13A:
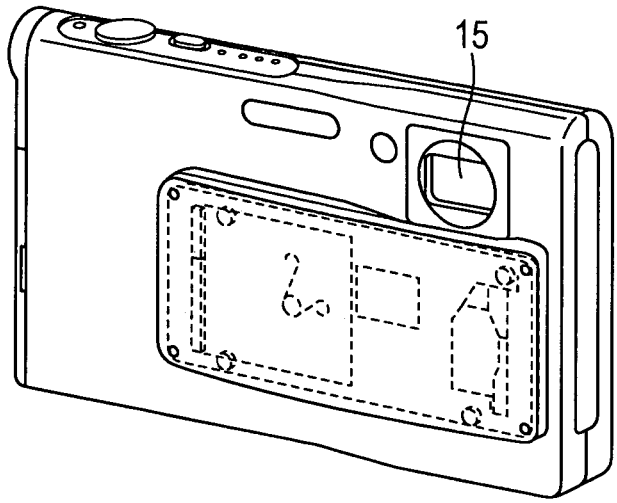
FIGS. 13A and 13B are perspective views of a digital still camera having the display device according to the embodiment of the present invention.
Figure 13B:
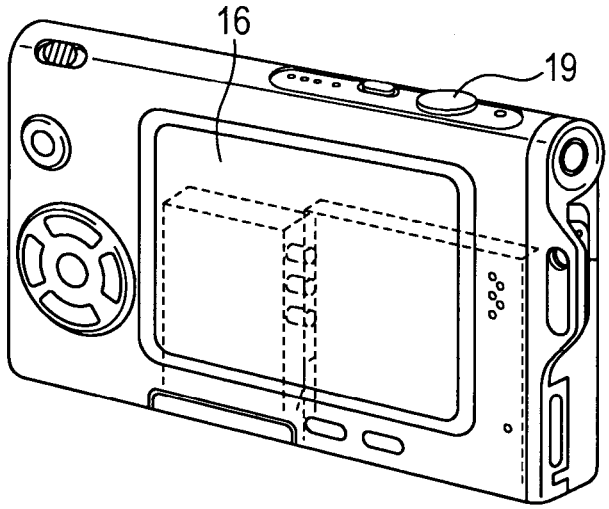

FIGS. 13A and 13B illustrate a digital camera to which the embodiment of the present invention is applied. FIG. 13A is a front view, and FIG. 13B is a back view. The digital camera includes an image-capturing lens, a light-emitting section 15 serving as a flash, a display section 16, a control switch, a menu switch, a shutter 19, and the like. The digital camera is fabricated by using the display device according to the embodiment of the present invention as the display section 16.

Figure 14:
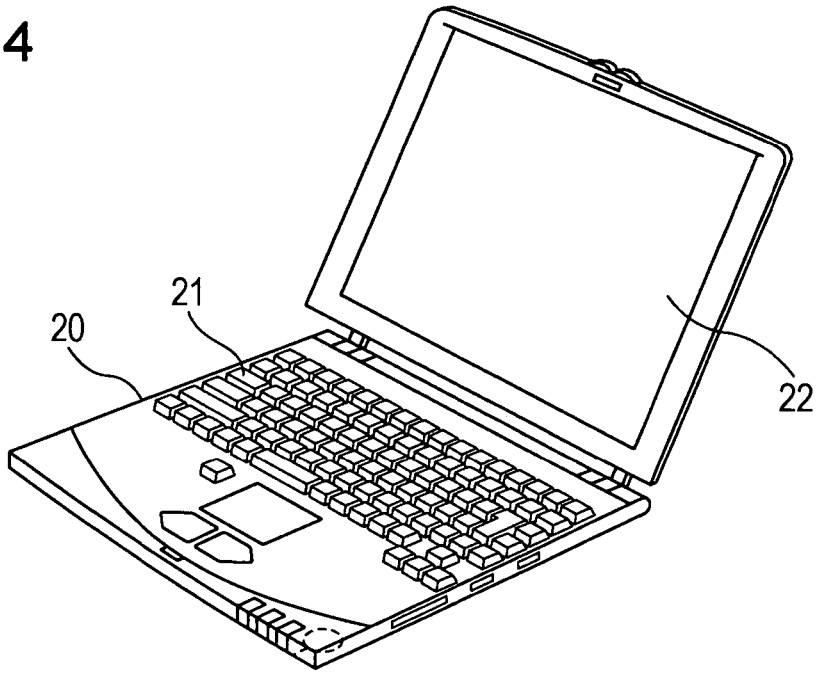
FIG. 14 is a perspective view of a notebook personal computer having the display device according to the embodiment of the present invention.

FIG. 14 illustrates a notebook personal computer to which the embodiment of the present invention is applied. The notebook personal computer includes a main body 20 including a keyboard 21 to be operated to enter characters and the like. A main-body cover includes a display section 22 for displaying an image. The notebook personal computer is fabricated by using the display device according to the embodiment of the present invention as the display section 22.

Figure 15A:
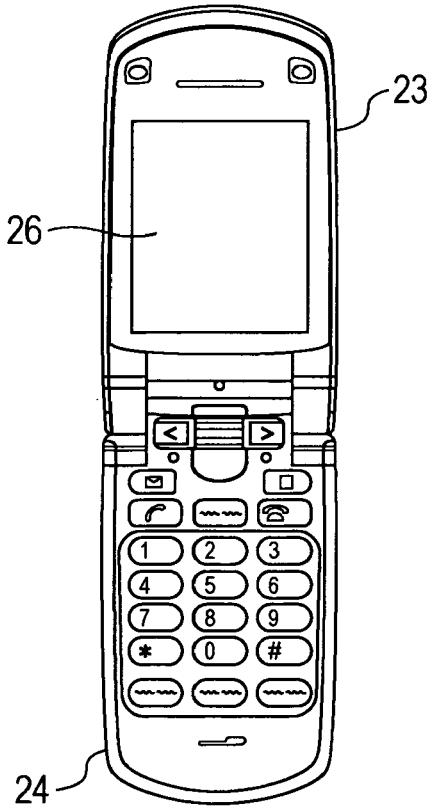
FIGS. 15A and 15B are illustrations of a mobile terminal apparatus having the display device according to the embodiment of the present invention.
Figure 15B:
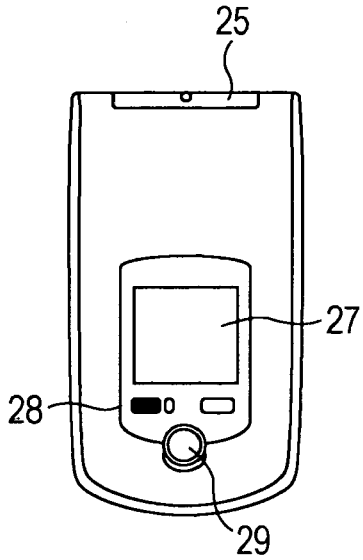

FIGS. 15A and 15B illustrate a mobile terminal apparatus to which the embodiment of the present invention is applied. FIG. 15A illustrates an opened state, and FIG. 15B illustrates a closed state. The mobile terminal apparatus includes an upper casing 23, a lower casing 24, a connecting part (hinge in this example) 25, a display 26, a sub-display 27, a picture light 28, a camera 29, and the like. The mobile terminal apparatus is fabricated by using the display device according to the embodiment of the present invention as the display 26 and the sub-display 27.

Figure 16:
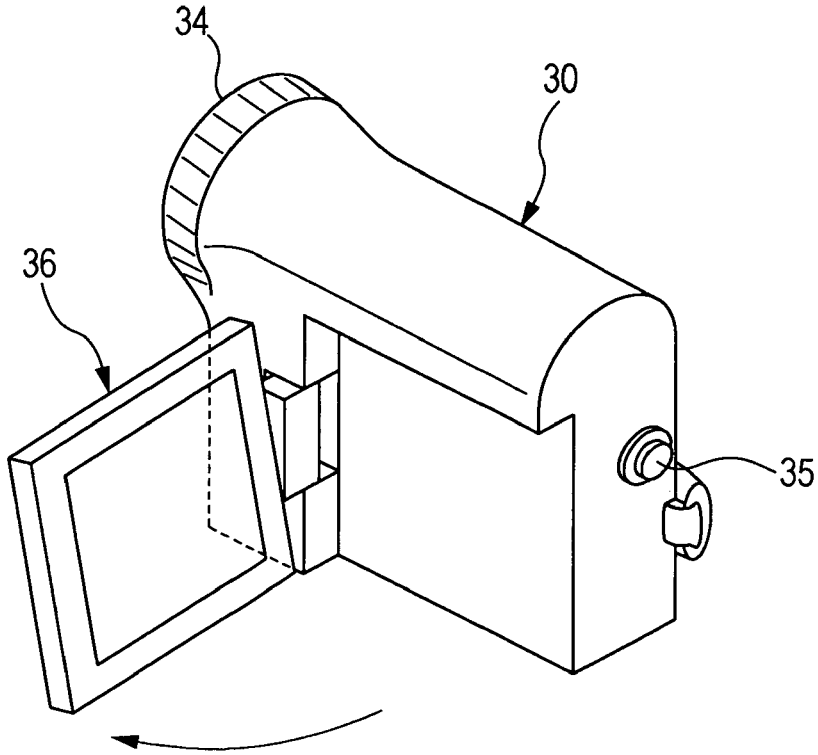
FIG. 16 is a perspective view of a video camera having the display device according to the embodiment of the present invention.

FIG. 16 illustrates a video camera to which the embodiment of the present invention is applied. The video camera includes a main body 30, a lens 34 for shooting an image of an object, which is disposed on a side face facing forward, a start/stop switch 35 for shooting an image, a monitor 36, and the like. The video camera is fabricated by using the display device according to the embodiment of the present invention as the monitor 36.

It should be understood by those skilled in the art that various modifications, combinations, sub-combinations, and alterations may occur depending on design requirements and other factors insofar as they are within the scope of the appended claims or the equivalents thereof.

What is claimed is:

1. A display device comprising:

a pixel array section; and a drive section, wherein the pixel array section includes power lines, scanning lines arranged in rows, signal lines arranged in columns, and pixels that are arranged in a matrix and that are disposed at intersections of the scanning lines and the signal lines, wherein each of the pixels at least includes a sampling transistor, a drive transistor, a light-emitting element, and a storage capacitor, wherein the sampling transistor has a control end connected to a corresponding one of the scanning lines and a pair of current ends connected between a corresponding one of the signal lines and a control end of the drive transistor, wherein the drive transistor has a pair of current ends, one current end being connected to the light-emitting element and the other current end being connected to a corresponding one of the power lines, wherein the storage capacitor is connected between the control end of the drive transistor and the one current end of the drive transistor, wherein the drive section includes a write scanner configured to sequentially supply a control signal to one of the scanning lines at a time in each horizontal scanning period, and a signal selector configured to supply a drive signal to each of the signal lines, the drive signal being switched between a signal potential and a reference potential in each horizontal scanning period, wherein the sampling transistor applies the drive signal to the control end of the drive transistor in accordance with the control signal, wherein the drive transistor supplies a drive current to the light-emitting element in accordance with the drive signal, wherein the write scanner includes output buffers, each of the output buffers being configured to output a control signal to a corresponding one of the scanning lines, the control signal including a first pulse and a second pulse in each horizontal scanning period, and wherein each of the output buffers includes a first output section connected to a fixed power supply and a second output section connected to a pulse power supply, the first output section outputting the first pulse, and the second output section extracting a pulse supplied from the pulse power supply and outputting the extracted pulse as the second pulse.

2. The display device according to claim 1, wherein the sampling transistor samples the reference potential of the drive signal in accordance with the first pulse output from the first output section, thereby causing the pixel to perform a threshold-voltage correcting operation for correcting a variation in a threshold voltage of the drive transistor, and wherein the sampling transistor samples the signal potential of the drive signal in accordance with the second pulse output from the second output section, thereby causing the pixel to write the signal potential in the storage capacitor and simultaneously to perform a mobility correcting operation for correcting a variation in mobility of the drive transistor.

3. The display device according to claim 2, wherein each of the output buffers in the write scanner sequentially outputs the first pulse and the second pulse in each horizontal scanning period so that the first pulse and the second pulse do not overlap each other with respect to time.

4. The display device according to claim 3, wherein each of the output buffers in the write scanner first outputs the first pulse and, after a period of time, outputs the second pulse in each horizontal scanning period.

5. The display device according to claim 2, wherein the drive section includes a power scanner configured to switch each of the power lines between a high potential and a low potential, and wherein, when each of the pixels performs the threshold-voltage correcting operation, the power scanner first switches a corresponding one of the power lines to the low potential and then to the high potential.

6. An electronic apparatus comprising the display device as set forth in claim 1.

7. The display device according to claim 1, wherein the first output section includes a p-type transistor and the fixed power supply is connected to the source of the p-type transistor.

8. The display device according to claim 1, wherein the second output section includes a p-type transistor and the pulse power supply is connected to the source of the p-type transistor.

* * * * *